US008077897B2

(12) United States Patent
Voishvillo

(10) Patent No.: US 8,077,897 B2
(45) Date of Patent: Dec. 13, 2011

(54) PHASING PLUG

(75) Inventor: Alexander Voishvillo, Simi Valley, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 854 days.

(21) Appl. No.: 12/137,215

(22) Filed: Jun. 11, 2008

(65) Prior Publication Data

US 2009/0310809 A1 Dec. 17, 2009

(51) Int. Cl.
*H04R 1/02* (2006.01)
*H04R 1/20* (2006.01)

(52) U.S. Cl. ..... 381/343; 381/340

(58) Field of Classification Search ..... 381/337–343; 181/152, 159, 177–195
See application file for complete search history.

(56) References Cited

U.S. PATENT DOCUMENTS

| | | | | |
|---|---|---|---|---|
| 5,878,148 | A | 3/1999 | Alexandrov | |
| 5,983,191 | A | 11/1999 | Ha et al. | |
| 6,064,745 | A * | 5/2000 | Avera | 381/343 |
| 6,205,228 | B1 * | 3/2001 | Czerwinski et al. | 381/340 |
| 6,320,970 | B1 * | 11/2001 | Czerwinski et al. | 381/343 |
| 2006/0193477 | A1 | 8/2006 | Zehnle et al. | |

FOREIGN PATENT DOCUMENTS

| | | | |
|---|---|---|---|
| DE | 4141843 | A1 | 6/1993 |
| DE | 19848491 | A1 | 4/2000 |
| EP | 1005252 | A2 | 5/2000 |

* cited by examiner

*Primary Examiner* — Tuan Nguyen
(74) *Attorney, Agent, or Firm* — The Eclipse Group LLP

(57) ABSTRACT

A phasing plug for a compression driver includes a base portion and a hub portion. The base portion includes a first side, a second side, and a plurality of apertures extending between the first and second sides. The hub portion extends from the base portion along an axis. A plurality of channels formed on the second side of the base portion, each channel extending from the hub portion to a corresponding one of a plurality of apertures extending between the first and second sides, the apertures formed to define lines cutting diagonally across the annular section.

17 Claims, 13 Drawing Sheets

PHASING PLUG

BACKGROUND OF THE INVENTION

1. Field of the Invention

This invention relates generally to electro-acoustical drivers and loudspeakers employing electro-acoustical drivers, and more particularly, to improved configurations for compression drivers.

2. Related Art

An electro-acoustical transducer or driver is utilized as a loudspeaker or as a component in a loudspeaker system to transform electrical signals into acoustical ones. The basic designs and components of various types of drivers are well-known and therefore need not be described in detail. Briefly, a driver receives electrical signals and converts the electrical signals to acoustic signals. The driver typically includes mechanical, electromechanical, and magnetic elements to effect this conversion. For example, the electrical signals may be directed through a circular voice coil that is attached to diaphragm and the voice coil positioned in an air gap with a radially oriented permanent magnetic field provided by a permanent magnet and steel elements of a magnet assembly. Due to the Lorenz force affecting the conductor of current positioned in the permanent magnetic field, the alternating current corresponding to electrical signals conveying audio signals actuates the voice coil to reciprocate back and forth in the air space and, correspondingly, move the diaphragm to which the coil is attached. The voice coil may be attached to a flexible diaphragm that is suspended by one or more supporting elements (e.g., a surround, spider, or the like) such that at least a portion of the diaphragm is permitted to move. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level.

The driver at its output side may be coupled to an acoustic waveguide, which is a structure that encloses the volume of medium into which sound waves are first received from the driver. The waveguide may be designed to increase the efficiency of the transducer and control the directivity of the propagating sound waves. The waveguide typically includes one open end coupled to the driver, and another open end or mouth downstream from the driver-side end. Sound waves produced by the driver propagate through the waveguide and are dispersed from the mouth to a, listening area. The waveguide is often structured as a horn or other flared structure such that the interior defined by the waveguide expands or increases from the driver-side end to the mouth.

One type of electro-acoustical transducers or drivers is a compression driver. A compression driver produces sound waves in a high-pressure enclosed volume, or compression chamber, before radiating the sound waves to the typically much lower-pressure open-air environment. The compression chamber is open to a phasing plug, which is a device that works as a connector between the compression chamber and the horn. The area of the entrance to the phasing plug is typically made smaller than the area of the diaphragm to provide increased efficiency compared to other types of drivers, such as a direct-radiating loudspeaker. In a direct-radiating loudspeaker, the output mechanical impedance of the vibrating diaphragm is significantly higher than the radiation impedance that causes "generator" (diaphragm) and "load" (radiation impedance) mismatch. In a compression driver, the loading impedance (entrance to the phasing plug) is significantly higher than the open air radiation impedance. This produces much better matching between "generator" and "load" and increases the efficiency of the transducer. In general, compression drivers are considered to be superior to direct-radiating drivers for generating high sound-pressure levels.

As noted, a compression driver utilizes a compression chamber on the output side of the diaphragm to generate relatively higher-pressure sound energy prior to radiating the sound waves from the loudspeaker. Typically, the phasing plug is interposed between the diaphragm and the waveguide or horn portion of the loudspeaker, and is spaced from the diaphragm by a small distance (typically a fraction of a millimeter). Accordingly, the compression chamber is bounded on one side by the diaphragm and on the other side by the phasing plug. The phasing plug typically includes apertures (i.e., passages or channels) that extend between the compression chamber and the waveguide or horn portion of the loudspeaker to provide acoustic pathways from the compression chamber to the waveguide. The cross-sectional area of the apertures is small in comparison to the effective area of the diaphragm, thereby providing air compression and increased sound pressure in the compression chamber.

The compression driver, characterized by having a phasing plug and a compression chamber, may increase the efficiency with which the mechanical energy associated with the moving diaphragm is converted into acoustic energy. Decreasing the parasitic compliance of air in the compression chamber prevents undesired attenuation of high-frequency acoustic signals. Properly positioning of the apertures in the phasing plug and the lengths of the passages may permit delivery of sound energy in phase from all parts of the diaphragm, suppression or cancellation of high-frequency standing waves in the compression chamber, and reduction or elimination of undesired interfering cancellations in the propagating sound waves.

There exists a need for improved designs for compression drivers so as to more fully attain their advantages such as high-frequency efficiency, while ameliorating their disadvantages such as detrimental acoustical non-linear effects, irregularity of frequency response, and limited frequency range.

SUMMARY

In view of the above, an improved phasing plug is provided for a compression driver. The phasing plug includes a base portion and a hub portion. The base portion includes a first side, a second side, and a plurality of apertures extending between the first and second sides. The hub portion extends from the base portion along an axis. A plurality of channels formed on the second side of the base portion, each channel extending from the hub portion to a corresponding one of a plurality of apertures extending between the first and second sides, the apertures formed to define lines cutting diagonally across the annular section.

In one example of the improved phasing plug, the lines formed by the apertures includes four lines arranged to form a square.

In another example of the improved phasing plug, the apertures form lines of apertures each tangential to a circle concentric with the annular section and having a smaller diameter than the annular section.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The description of examples of the invention below can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
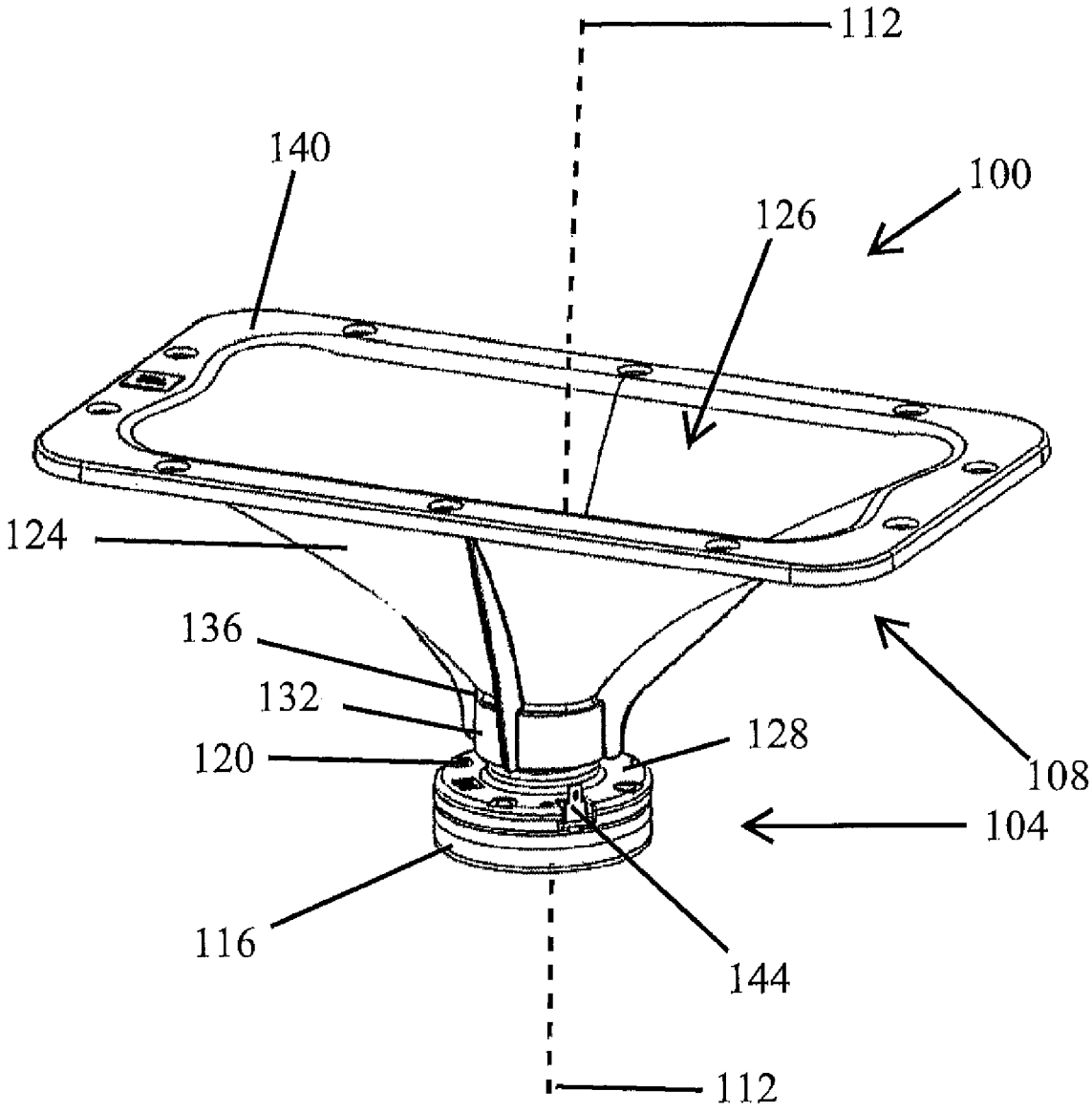
FIG. 1 is a perspective view of an example of a horn loudspeaker in which a compression driver as described below may be implemented.

FIG. 1 illustrates a perspective view of an example of a horn loudspeaker 100 in which a compression driver as described below may be implemented. The loudspeaker 100 includes an electro-acoustical transducer section 104. In some implementations, the loudspeaker 100 may also include a waveguide or horn 108. The transducer section 104 and horn 108 are generally disposed about a central axis 112. The transducer section 104 may include a rear section 116 and a housing or adapter 120. The rear section 116 may be coupled to the housing 120 by any suitable means. The rear section 116 and housing 120 may enclose components for realizing a driver of the compression type, an example of which is described below. The horn 108 may include a horn structure 124 such as one or more walls that enclose an interior 126 of the horn 108. As illustrated, the horn structure 124 may be flared or tapered outwardly from the central axis 112 to provide an expanding cross-sectional area through which sound waves propagate. The housing 120 generally includes a first or input end 128 and a second or output end 132. Likewise, the horn 108 generally includes a first or input end 136 and a second or output end commonly referred to as a mouth 140. The output end 132 of the housing 120 may be coupled to the input end 136 of the horn 108 by any suitable means. Generally, the loudspeaker 100 receives an input of electrical signals at an appropriate connection such as contacts 144 provided by the transducer section 104. The loudspeaker 100 converts the electrical signals into acoustic signals according to mechanisms briefly summarized above and readily appreciated by persons skilled in the art. The acoustic signals propagate through the interior of the housing 120 and horn 108 and exit the loudspeaker 100 at the mouth 140 of the horn 108.

As a general matter, the loudspeaker 100 may be operated in any suitable listening environment such as, for example, the room of a home, a theater, or a large indoor or outdoor arena. Moreover, the horn loudspeaker 100 may be sized to process various ranges of the audio frequency band, such as the high-frequency range (generally 2 kHz-20 kHz) typically produced by tweeters, and the midrange (generally 200 Hz-5 kHz) typically produced by midrange drivers. Low-frequency ranges (generally 20 Hz-200 Hz) are typically produced by direct-radiating woofers.

Figure 2:
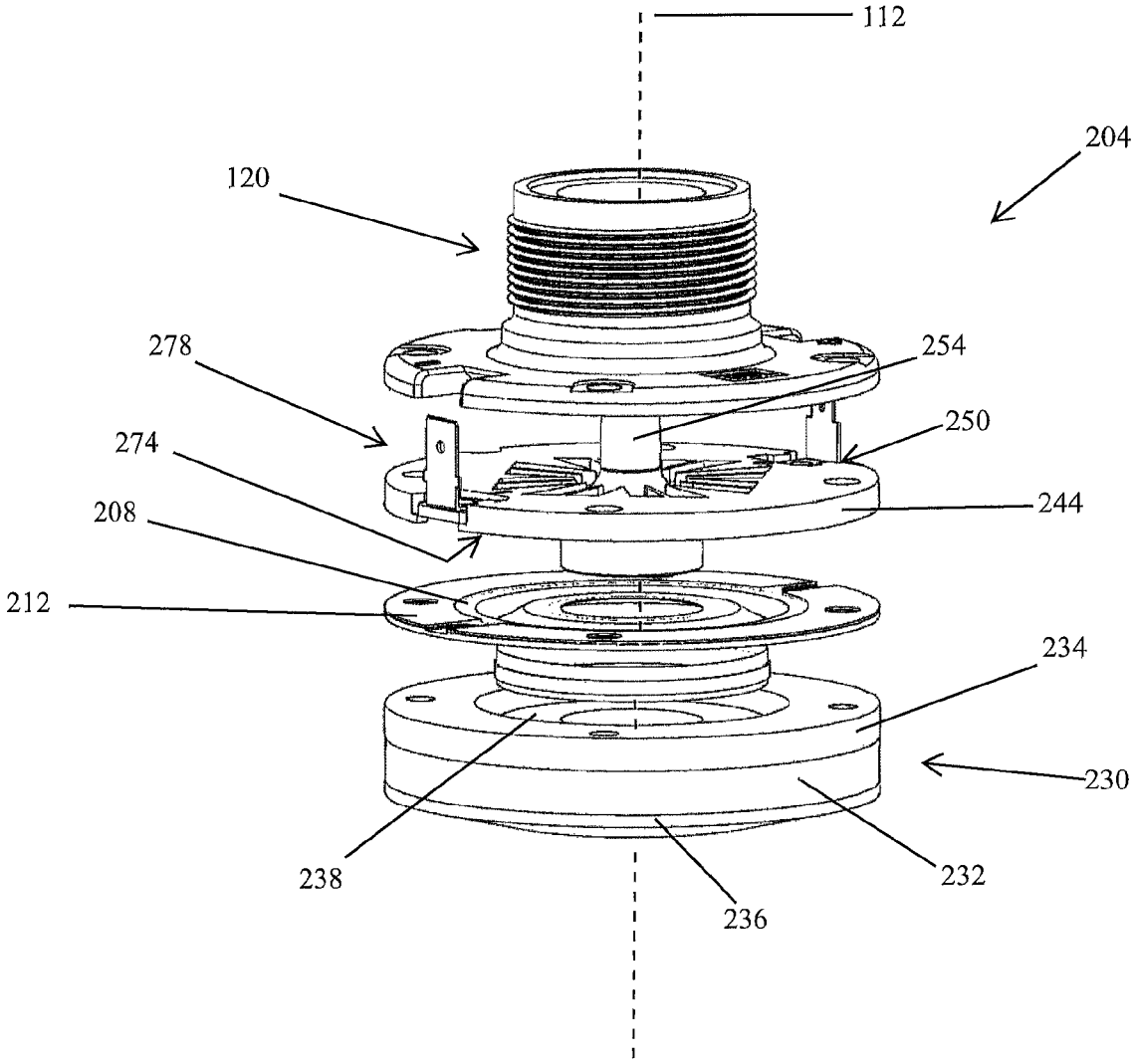
FIG. 2 is an exploded perspective view of a compression driver that may be provided with the loudspeaker of FIG. 1.

FIG. 2 is an exploded perspective view of an example of a compression driver 204 and associated components and features that may be provided as parts of the transducer section 104 (FIG. 1) of the horn loudspeaker 100. The compression driver 204 may include a flexible diaphragm 208, one or more suspension members 212 for supporting the diaphragm 208 while enabling the diaphragm 208 to oscillate, and a magnet assembly 230 that may comprise an annular permanent magnet 232, an annular top plate 234, and a back plate 236 that includes a centrally disposed annular pole piece 238, for providing a permanent magnetic field in the gap (see FIG. 3 and related description below) between the pole piece 238 and an inside surface of the annular top plate 234 for electrodynamic coupling with a voice coil (described below and illustrated in FIG. 3). The entire annular diaphragm actually performs the function of surround. In the compression drivers based on the dome diaphragm, the surround (suspension) does perform a function of a separate suspension.

In the example illustrated in FIG. 2, the diaphragm 208 is an annular diaphragm; that is, it is clamped inside and outside, and configured as an annular ring that is disposed coaxially with the central axis 112. In other implementations, however, the diaphragm 208 may have other suitable configurations such as a dome or a cone. The compression driver 204 may also include a phasing plug assembly 240 that comprises the housing 120 and a phasing plug 244 generally disposed within the housing 120. The body of the phasing plug 244 may include a base portion 250 and a central or hub portion 254, both of which are coaxially disposed about the central axis 112. The hub portion 254 may also be referred to as a bullet. The base portion 250 may further include one or more apertures (described below and illustrated in FIGS. 4-6 and 9) that extend as channels or passages through the thickness of the base portion 250 from the input side 274 to the output side 278.

Figure 3:
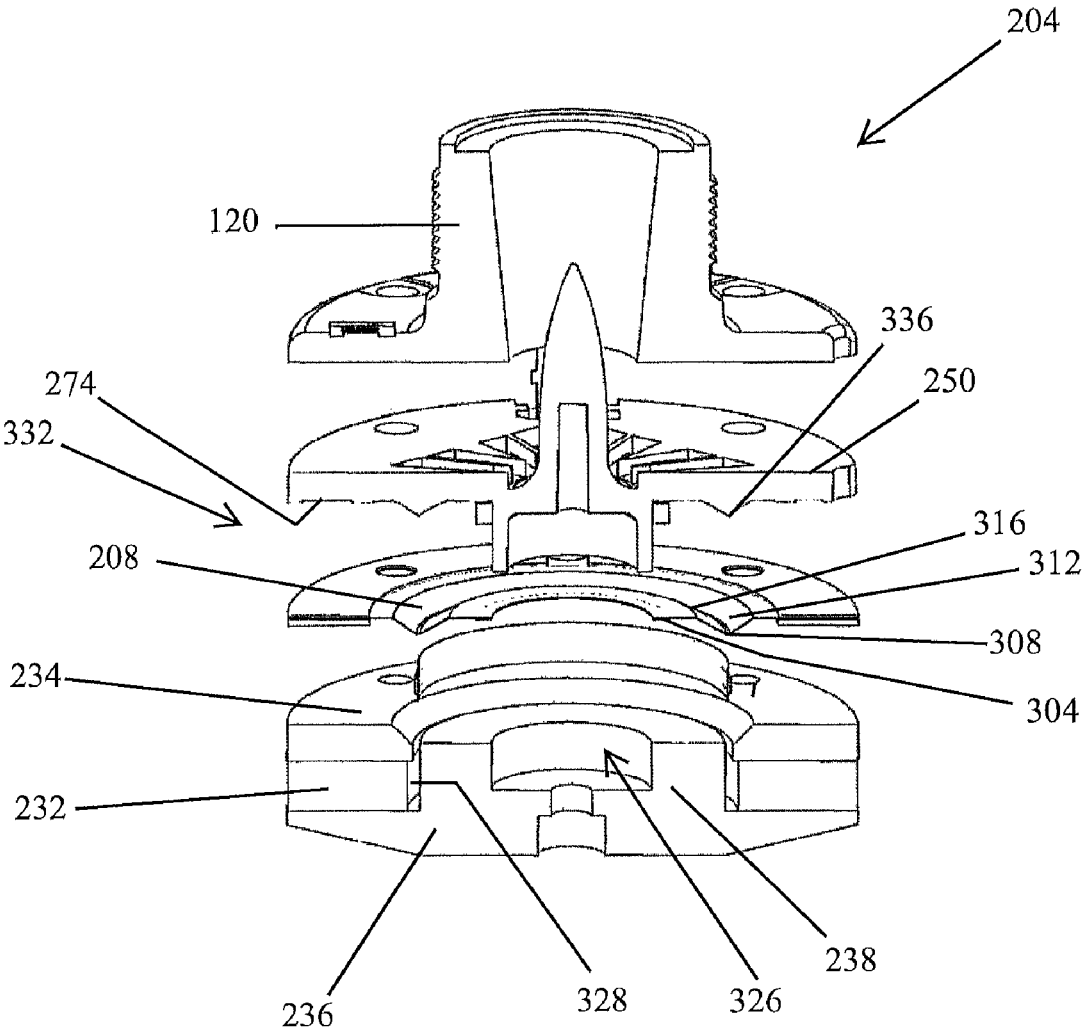
FIG. 3 is an exploded cross-sectional view of the compression driver of FIG. 2.

FIG. 3 is an exploded cross-sectional view of the compression driver 204 illustrating additional components and features that may be provided. The compression driver 204 additionally includes a magnet or voice coil 304 for producing the movement of the flexible portion of the diaphragm 208 and a structural member such as a coil former 308 for supporting the voice coil 304. The diaphragm 208 may include a profiled section such as a V-shaped section 312 having a circular apex 316 coaxial with the central axis 112. The voice coil 304 or the former 308 may be attached to the diaphragm 208 at the apex 316 to facilitate actuation of the diaphragm 208 by the voice coil 304. The compression driver 204 may also include the afore-mentioned annular top plate 234 and back plate 236. The pole piece 238, which may be integrated with the back plate 236, may include a central bore 326. The top plate 234 and outer magnet 232 on the one side and the pole piece 238 on the other side cooperatively define a magnetic or air gap 328. In the assembled form of the compression driver 204 (see FIG. 3), the voice coil 304 and coil former 308 are disposed in this gap 328 such that the voice coil 304 is immersed in a magnetic field, and the gap 328 provides axial spacing through which the voice coil 304 may oscillate. Upon assembly of the compression driver 204, a compression chamber is defined in a spacing 332 between the diaphragm 208 and the input side 274 of the base portion 250. In practice, the height of the compression chamber (i.e., the distance between the diaphragm 208 and the input side 274 of the base portion 250) may be quite small (e.g., approximately 0.5 mm or less) such that the volume of the compression chamber is also small. In implementations where the diaphragm 208 includes a V-shaped section 312, the base portion 250 at the input side 274 may also include a complementary V-shaped section 336 (or other type of profiled section) positioned in general alignment with the V-shaped section 312 to maintain the small volume of the compression chamber.

Figure 4:
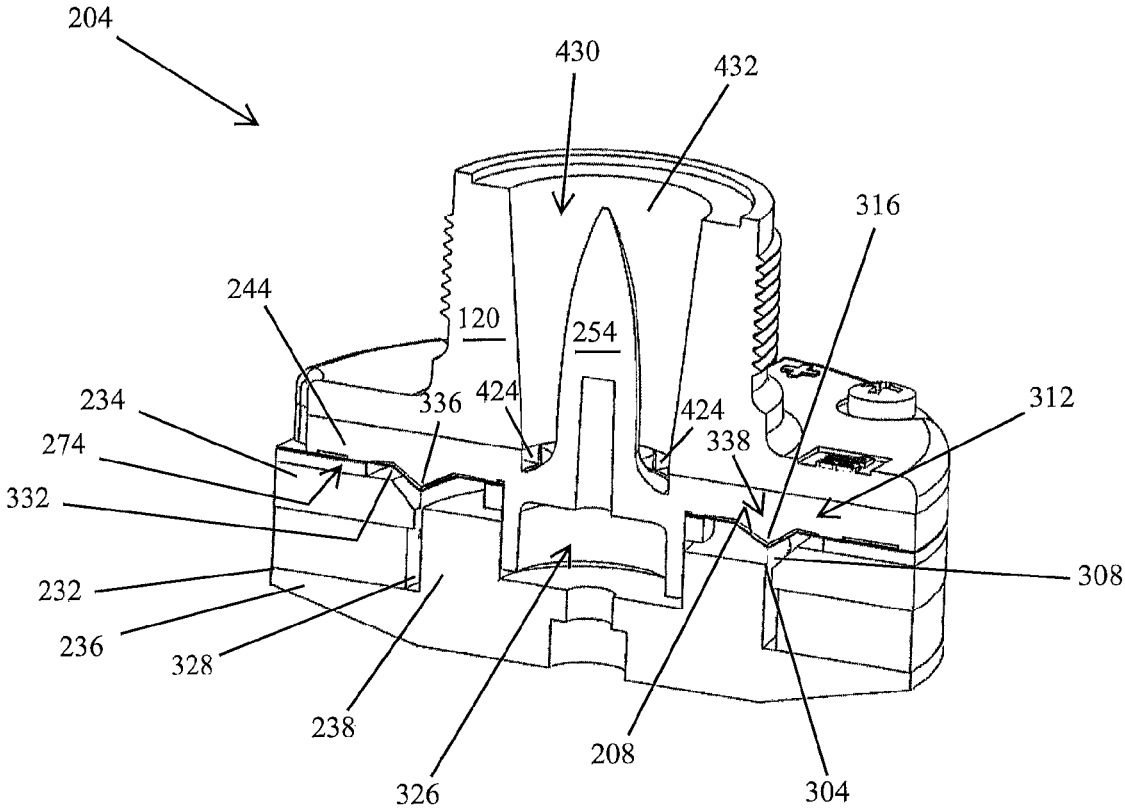
FIG. 4 is a perspective cross-sectional view of an example of the compression driver in FIG. 2 in assembled form.

FIG. 4 is a perspective cross-section view of the compression driver 204 in assembled form. The view of the compression driver 204 in FIG. 4 shows the voice coil 304, the diaphragm 208, and a coil former 308 for supporting the voice coil 304. The diaphragm 208 includes the profiled V-shaped section 312 having a circular apex 316 coaxial with the central axis 112. The voice coil 304 or the coil former 308 may be attached to the diaphragm 208 at the apex 316 to facilitate actuation of the diaphragm 208 by the voice coil 304. The compression driver 204 in FIG. 4 also includes the annular top plate 234, the back plate 236, and outer magnet between the top plate 234 and back plate 236. The pole piece 238, which may be integrated with the back plate 236, includes the central bore 326. The top plate 234 and outer magnet 232 on the one side and the pole piece 238 on the other side cooperatively define the air gap 328. The voice coil 304 and coil former 308 are disposed in the gap 328 such that the voice coil 304 is immersed in a magnetic field, and the gap 328 provides axial spacing through which the voice coil 304 may oscillate. A compression chamber 332 is defined between the diaphragm 208 and an input side 274 of the phasing plug 244. The phasing plug 244 includes the hub 254 situated within a waveguide 430 formed by an inner surface 432 of the housing 120. The housing 120 is flush against the phasing plug 244 on its output side 278. In implementations where the diaphragm 208 includes the V-shaped section 312, the phasing plug 244 at the input side 274 may also include the complementary V-shaped section 336 (or other type of profiled section) positioned in general alignment with the V-shaped section 312 to maintain the small volume of the compression chamber.

The phasing plug 244 may also include a set of channels 424 that lead to apertures (described below with reference to FIGS. 5-9) that provide an opening for sound waves created by the diaphragm 208. The channels 424 are bounded on top by the surface of the input side of the housing 120 to form channel waveguides. The sound waves propagate through the channel waveguides formed by the channels 424 and into the waveguide 430 formed by the hub 254 and the inside surface 432 of the housing 120.

Figure 5:
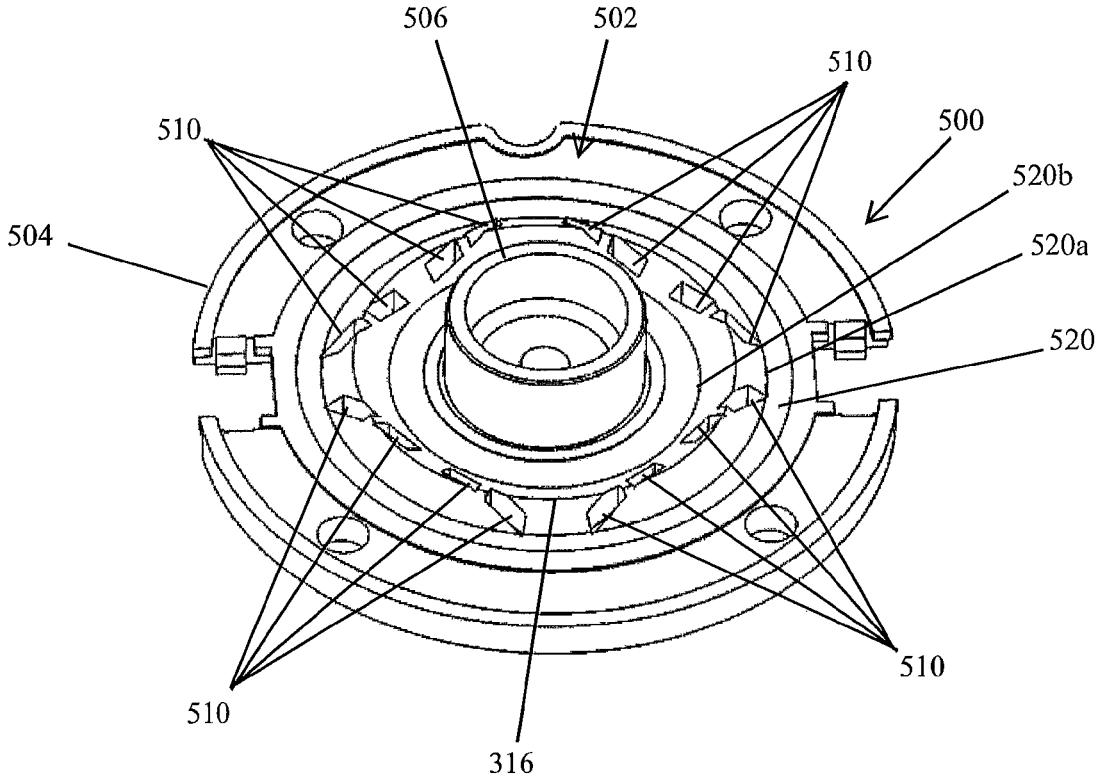
FIG. 5 is a perspective view of an example of a phasing plug that may be utilized in the compression driver illustrated in FIG. 4 from the perspective view of the input side of the phasing plug.

FIG. 5 illustrates one example of a phasing plug 500 that may be used in the compression driver 204 in FIG. 4. The phasing plug 500 in FIG. 5 is shown from the perspective of its input side 502, i.e., the side on which the diaphragm 406 and compression chamber of the compression driver 204 may be located (see FIG. 4). The phasing plug 500 may include a base portion 504 and a central or hub portion on an output side (shown in FIG. 6), both of which are coaxially disposed about a central axis. The phasing plug 500 may include a mounting feature 506 on the input side 502 that depends downwardly from the base portion 504 of the phasing plug 500. The mounting feature 506 may have any configuration suitable for coupling the phasing plug 500 to the rear section 116 of the loudspeaker 100 (FIG. 1). In the illustrated example, the mounting feature 506 is provided in the form of a segmented cylinder that is adapted to be press-fitted into the central bore 326 formed in the pole piece 238 or back plate 236 (FIG. 4). As illustrated in FIG. 5, the base portion 504 of the phasing plug 500 may be generally circular or may have any other suitable geometry.

The base portion 504 may further include one or more apertures 510 that extend as channels or passages through the thickness of the base portion 504 from the input side 502 to the output side of the phasing plug 500. The apertures 510 may be formed on an annular section 520 formed on the input side 502 of the base portion 504 and substantially overlays an annular diaphragm in the assembled compression driver (see FIGS. 1-4). The annular section 520 is defined in FIG. 5 by a first circumference 520*a* and a second smaller circumference 520*b*. The first and second circumferences 520*a,b* may be located substantially where the diaphragm is suspended. The annular section 520 in FIG. 5 may be the same as the V-shaped section 336 described above with reference to FIGS. 3-5.

The annular section 520 may conform to the profile of the diaphragm in the assembled compression driver. The examples illustrated in FIGS. 1-4 illustrate phasing plugs in drivers that implement V-shaped annular diaphragms. Annular diaphragms having other profiles may also be used. For example, examples of phasing plugs may be implemented in drivers that use annular diaphragms having other profiles such as a single half roll, and a dual half roll diaphragm.

Phasing plugs may be implemented for annular diaphragms of different profiles where the apertures 510 are not formed in a region of maximum displacement on the annular diaphragm. In general, the apertures 510 should not be formed within a circumferential region of maximum displacement.

The apertures 510 are formed in a pattern that is neither radial nor circumferential relative to the center of the base portion 504. That is, the apertures 510 form neither a circle nor do they radiate from the center of the base portion 504. In the example phasing plug 500 shown in FIG. 5, the apertures 510 extend along four lines that cut diagonally across the annular section 520. The slots are diagonally oriented to average out the sound pressure and to avoid picks and deeps on the frequency response caused by the mechanical resonances of the diaphragm and acoustical resonances of the compression chamber. The four lines in the example shown in FIG. 5 form a square centered at the center of the phasing plug 500.

Figure 6:
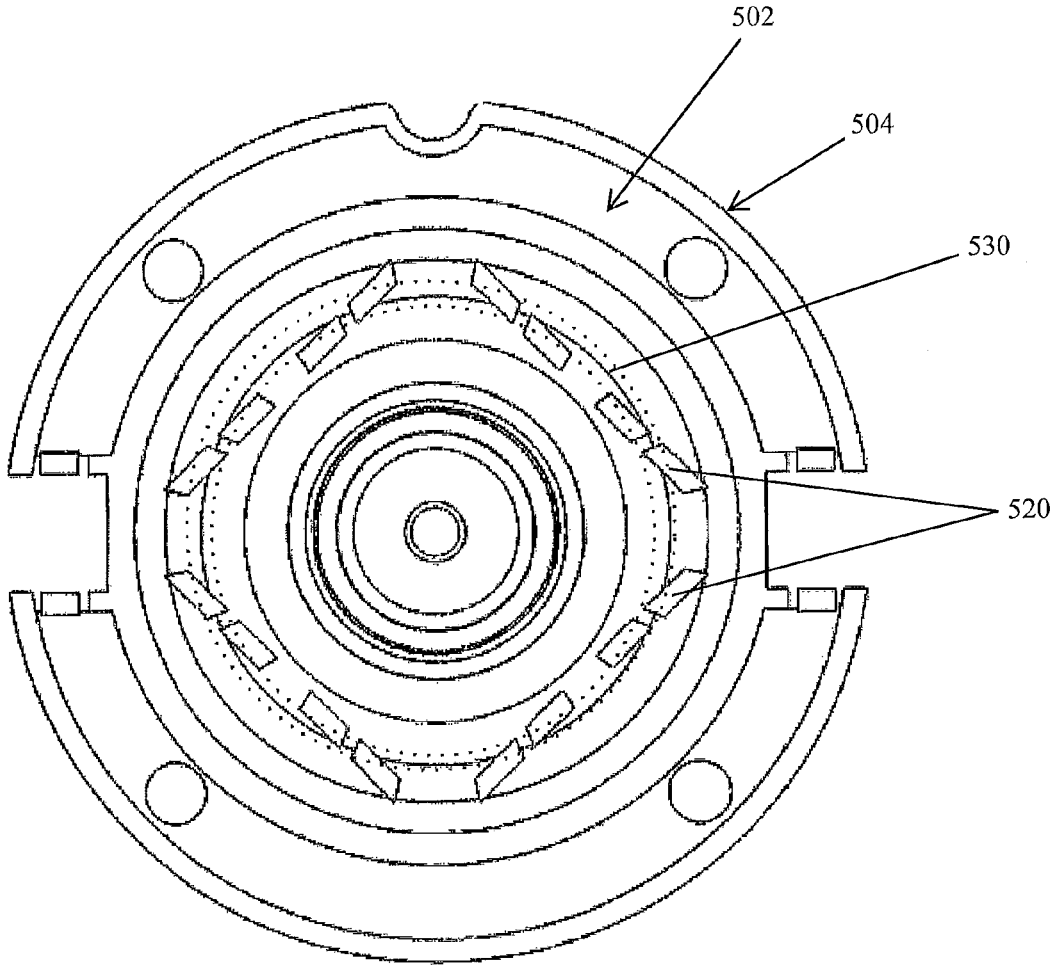
FIG. 6 is a bottom view of the phasing plug illustrated in FIG. 5 from the input side of the phasing plug.

FIG. 6 is a bottom view of the phasing plug 500 in FIG. 5 from the input side 502 of the base portion 504. The apertures 510 in FIG. 6 are shown arranged to form a square with four lines of apertures 510 that cut across the annular section 520 as described above with reference to FIG. 5. As described above, the apertures 510 are placed to create openings that are not on the middle part of the cross-section of the annular section 520. In operation, the apertures 510 provide a space for the sound to travel from the compression chamber (see spacing 332 in FIG. 3), through the channels 424 (in FIG. 4) and to the waveguide 430 (in FIG. 4). The annular section 520 of the phasing plug 500 may include a closed region 530 in the area between dotted circumferences near the circular apex 316 of the annular section 520. The closed region 530 improves the efficiency of the compression driver by ensuring that the open area of the apertures 510 does not extend substantially into the region of maximum displacement. If there was a substantial open area of the apertures 510 in the closed region 530, which coincides with the region of maximum displacement of the diaphragm the radiation from this area would occur with substantially less compression and correspondingly, the efficiency of the driver may suffer. The efficiency is increased if the maximum displacement provides compression.

Figure 7:
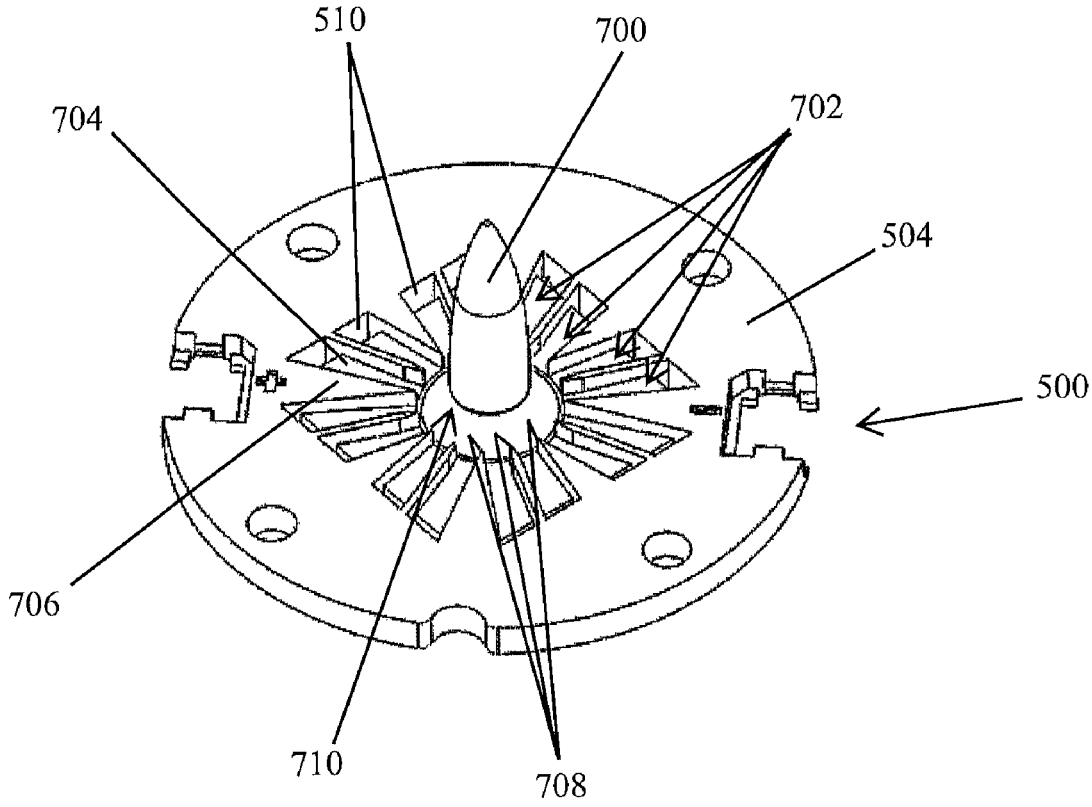
FIG. 7 is a perspective top view of the phasing plug in FIG. 5 from the perspective view of the output side of the phasing plug.

FIG. 7 is a perspective top view of the phasing plug 500 in FIG. 5 from the output side of the phasing plug 500. The view of the phasing plug 500 in FIG. 7 depicts a hub 700 (or "bullet") in the center of the base portion 504. Extending radially outward from the hub 700 is a set of channels 702 that terminate at corresponding apertures 510. Each channel 702 includes a lower level surface 704 inside the channel below an upper level surface 706. The hub 700 extends from the at the lower level surface 704 of the channels 702. The lower level surface 704 may have a conical expansion to provide a gradual increase of the cross-sectional areas of the channels 702. The upper surface 706 of each channel 702 forms the area between adjacent channels 702. When assembled, the upper surface 706 between adjacent channels 702 is flush against the input side 436 surface of the housing 434.

The upper surface 706 between adjacent channels 702 narrows as each channel 702 approaches the hub 700. The upper surface 706 and channels 702 form a substantially circular formation of channel ports 708 around the hub 700. The ports 708 at each channel 702 also form a substantially circular space 710 between the ports 708 and the surface of the hub 700. During operation of the loudspeaker, sound waves created by the diaphragm 406 (in FIG. 4) propagate through the apertures 510 and through the channels 702. The sound waves are then radiated through the space 710 at the base of the hub 700 and into the waveguide 430 described above with reference to FIG. 4.

Figure 8:
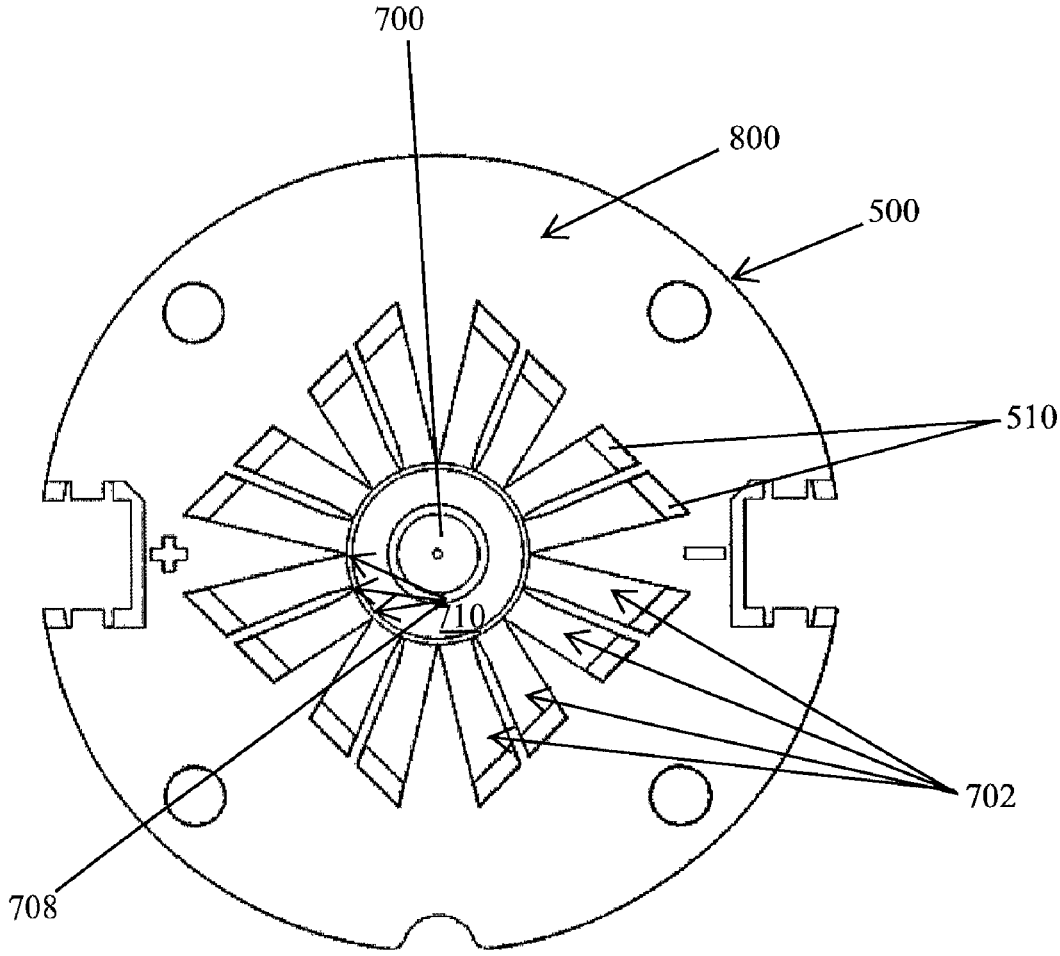
FIG. 8 is a top view of the phasing plug in FIG. 5 from the output side of the phasing plug.

FIG. 8 is a top view of the phasing plug 500 in FIG. 5 from the output side 800 of the phasing plug 500. FIG. 8 shows the hub 700 surrounded by the space 710 formed by the substantially circular formation of ports 708 around the hub 700. The ports 708 extend outwardly as channels 702 terminating at the apertures 510. In operation and assembled in the loudspeaker, the diaphragm 406 (in FIG. 4) creates sound waves that travel through the apertures 510, down the channel waveguides formed by the channels 702. The sound waves travel into the space 710 formed by the circular formation of ports 708 around the hub 700 into the space bounded by the waveguide 430 (in FIG. 4).

Figure 9:
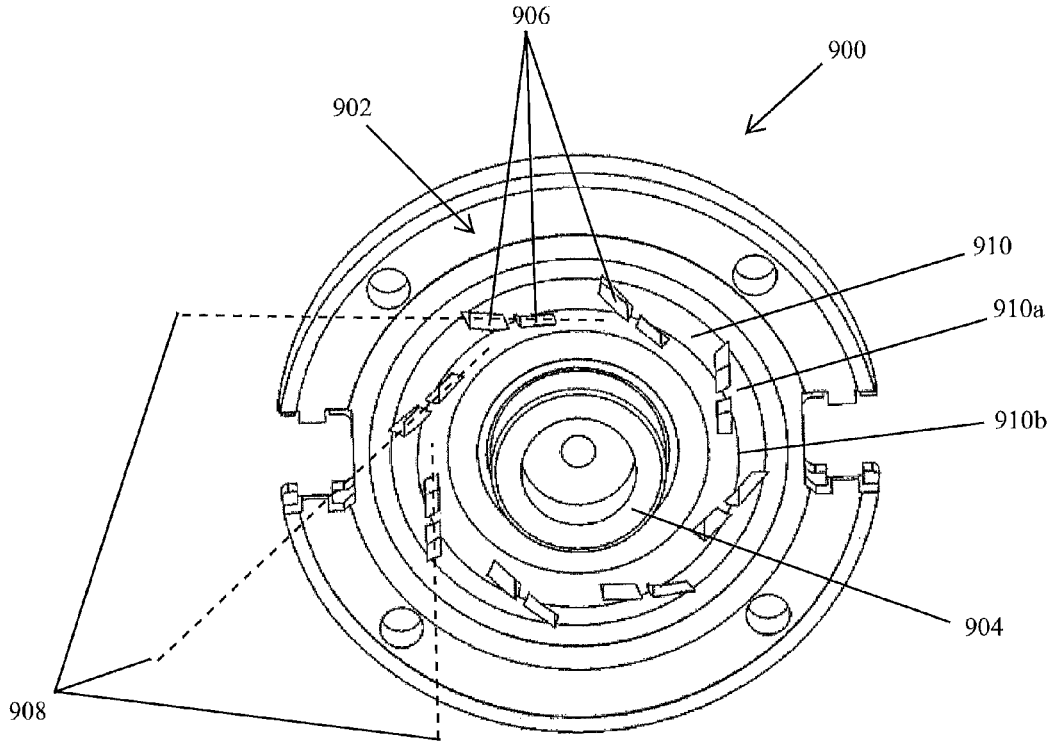
FIG. 9 is a perspective view of another example of a phasing plug that may be utilized in the compression driver illustrated in FIG. 4 from the perspective view of the input side of the phasing plug.

FIG. 9 is a perspective view of another example of a phasing plug 900 that may be utilized in the compression driver illustrated in FIG. 4 from the perspective view of an input side 902 of the phasing plug 900. FIG. 9 shows a mounting feature 904 similar to the mounting feature 506 on the phasing plug 500 in FIG. 5. The phasing plug 900 in FIG. 9 may be the same or similar to the phasing plug 500 in FIG. 5 except in the pattern formed by a set of apertures 906 in the phasing plug 900 in FIG. 9. As shown in FIG. 9, the apertures 906 in FIG. 9 form lines 908 that cut diagonally across an annular section 910 formed concentric with the center of the phasing plug 900. The lines 908 formed by the apertures 906 may be tangential to circles that are smaller in diameter than the circle formed by the annular section 910 and concentric with the center of the annular section 910.

Figure 10:
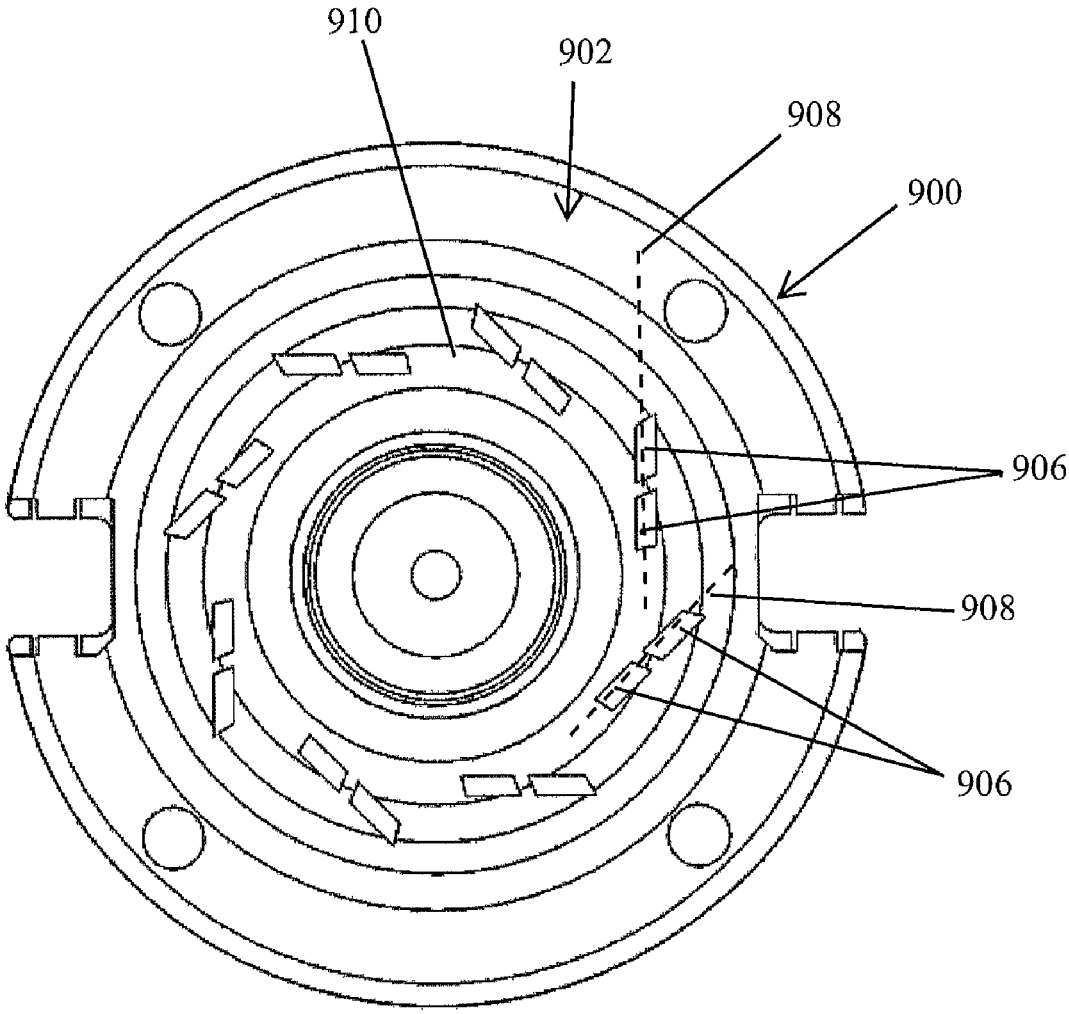
FIG. 10 is a bottom view of the phasing plug illustrated in FIG. 9 from the input side of the phasing plug.

FIG. 10 is a bottom view of the phasing plug 900 illustrated in FIG. 9 from the input side 902 of the phasing plug 900. The apertures 906 in FIG. 10 are shown arranged in lines 908 that are tangential to circles that are smaller in diameter than the circle formed by the annular section 910 and concentric with the center of the phasing plug 900. The annular section 910 may also have a closed region at the circular apex of the annular section 910 and have the apertures 906 formed away from the circular apex as described above with reference to FIGS. 5 and 6.

Figure 11:
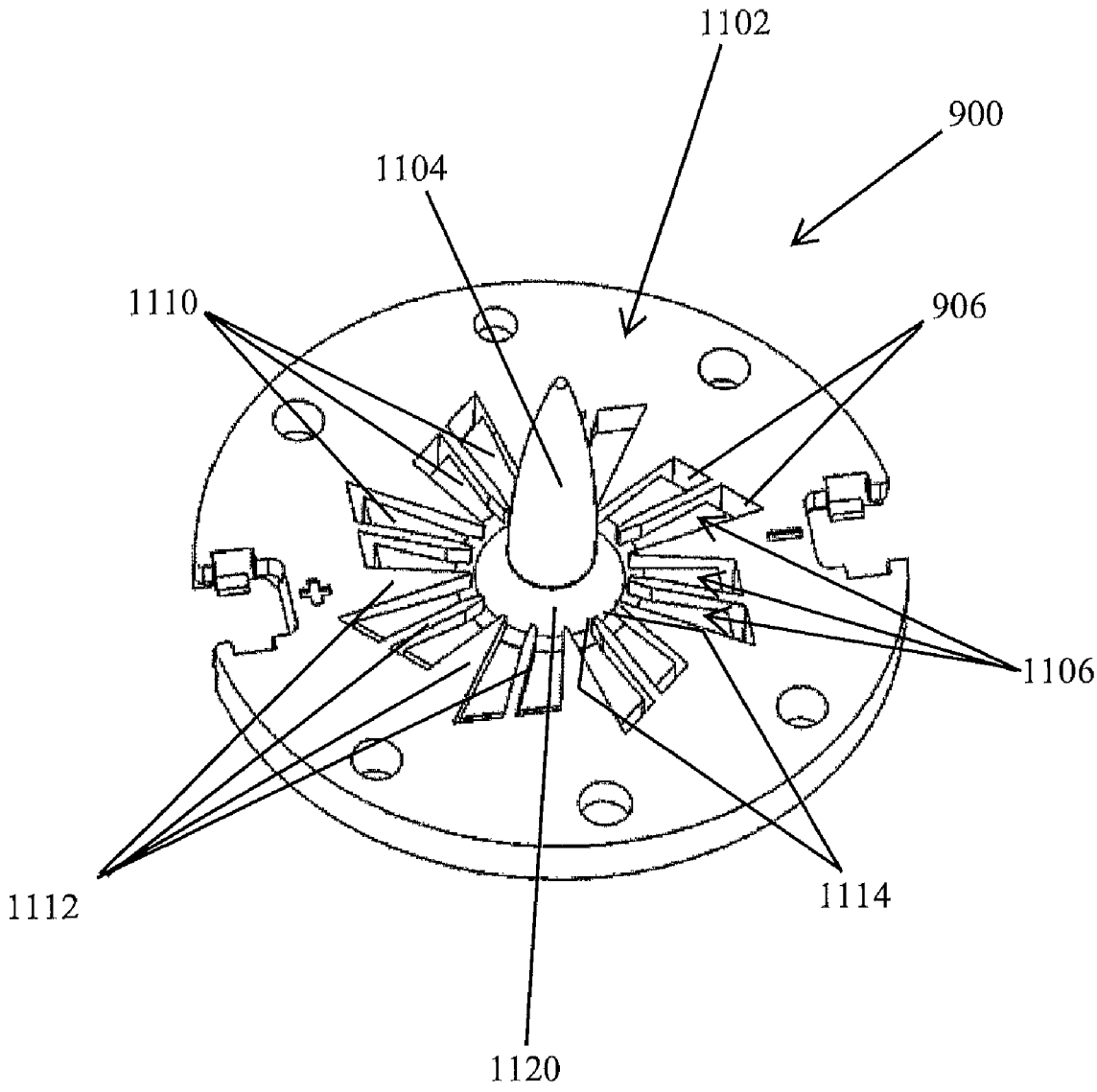
FIG. 11 is a perspective top view of the phasing plug in FIG. 9 from the perspective view of the output side of the phasing plug.

FIG. 11 is a perspective top view of the phasing plug 900 in FIG. 9 from the perspective view of an output side 1102 of the phasing plug 900. FIG. 11 shows the hub 1104 in the center of the phasing plug 900. The apertures 906 are shown in the pattern described above with reference to FIGS. 9 and 10. The apertures 906 provide openings in the phasing plug 900 at the end of corresponding channels 1106. The channels 1106 may be formed in the phasing plug 900 by a lower surface 1110 and an upper surface 1112. The upper surface 1112 and channels 1106 form a substantially circular formation of channel ports 1114 around the hub 1104. The ports 1114 at each channel 1106 also form a substantially circular space 1120 between the ports 1114 and the surface of the hub 1104. During operation of the loudspeaker, sound waves created by the diaphragm 406 (in FIG. 4) propagate through the apertures 906 and through the channels 1106. The sound waves are then radiated through the space 1120 at the base of the hub 1104 and into the waveguide 430 described above with reference to FIG. 4.

Figure 12:
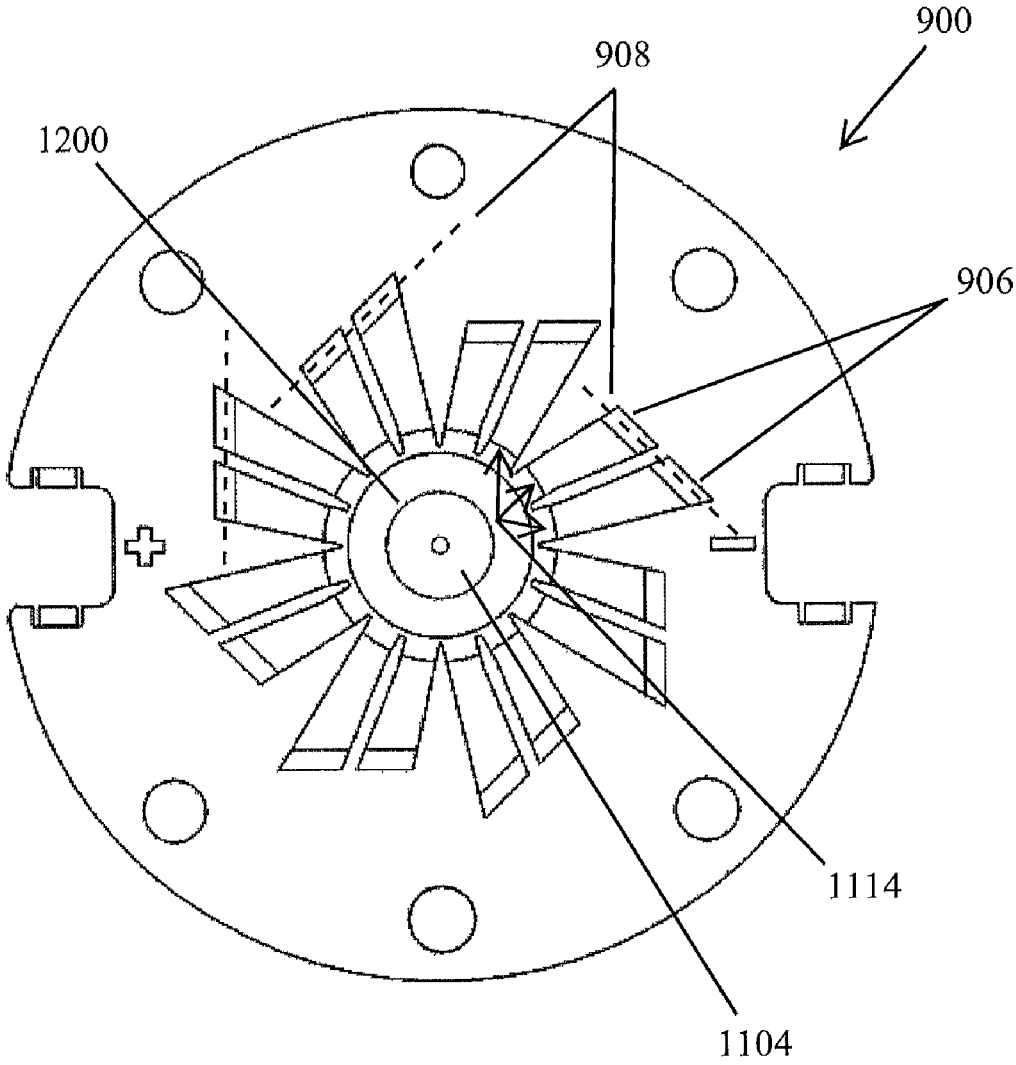
FIG. 12 is a top view of the phasing plug in FIG. 9 from the output side of the phasing plug.

FIG. 12 is a top view of the phasing plug 900 in FIG. 9 from the output side 1102 of the phasing plug. FIG. 12 shows the lines 908 along which the apertures 906 are formed. FIG. 12 also shows the hub 1104 surrounded by the space 1120 formed by the substantially circular formation of ports 1114 around the hub 1104. The ports 1114 extend outwardly as channels 1106 terminating at the apertures 906. In operation and assembled in the loudspeaker, the diaphragm 406 (in FIG. 4) creates sound waves that travel through the apertures 906, down the channel waveguides formed by the channels 1106. The sound waves travel into the space 1120 formed by the circular formation of ports 1114 around the hub 1104 into the space bounded by the waveguide 430 (in FIG. 4).

Figure 13:
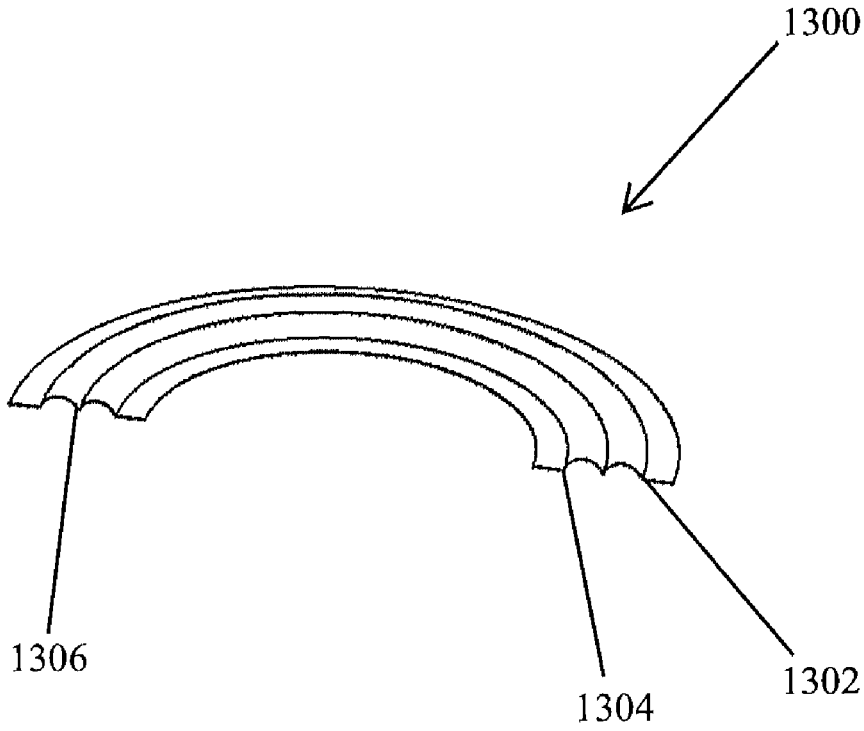
FIG. 13 is a perspective sectional view of an example of a dual half roll annular diaphragm that may be implemented in an example compression driver.

It is to be understood by those of ordinary skill in the art that example implementations of the phasing plug described above may be provided for use with annular diaphragms other than the V-shaped annular diaphragm used in the above-described examples. FIG. 13 is a perspective sectional view of an example of a dual half roll annular diaphragm 1300 that may be implemented in an example compression driver. The dual half roll annular diaphragm 1300 includes a first circumference 1302 and a second circumference 1304. The dual half roll annular diaphragm 1300 in FIG. 13 includes a region of maximum displacement 1306, which defines the portion of the annular diaphragm that generates the most sound pressure during operation. As described above, the phasing plug made to operate with the annular diaphragm 1300 in FIG. 13 includes apertures that are not substantially open at the region of maximum displacement 1300.

The example implementations disclosed above offer significant flexibility in the specification of compression drivers for desired applications and frequency ranges in sound production. The compression ratio may be controlled by changing the geometry and dimensions of the channels formed in the phasing plug while, at the same time, preserving the continuity of the area of expansion defined by the waveguide of the phasing plug assembly. Accordingly, the implementations disclosed herein provide flexible control over efficiency of the compression driver and over the shape of its frequency response.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A phasing plug for a compression driver, comprising:

a base portion including a first side and a second side, and an annular section defined on the first side by a first circumference and a second smaller circumference, the first and second circumferences having a common center in the base portion, where the annular section substantially overlays an annular diaphragm in an assembled compression driver;

a hub portion extending from the second side of the base portion substantially perpendicularly along an axis at the common center on the base portion;

a plurality of channels formed on the second side of the base portion, each channel extending from the hub portion to a corresponding one of a plurality of apertures defined by an open area extending between the first and second sides, the apertures formed to define lines cutting diagonally across the annular section.

2. The phasing plug of claim 1, where the plurality of apertures include a plurality of sets of apertures, each set of apertures forming a line of apertures.

3. The phasing plug of claim 2, where the plurality of apertures includes four sets of apertures each set forming a line of apertures arranged to cut across the annular section to form a square pattern.

4. The phasing plug of claim 2, where the plurality of apertures include a plurality of sets of apertures each set forming a line of apertures tangential to a circle concentric with the annular section and having a smaller diameter than the annular section.

5. The phasing plug of claim 1 where the annular section includes a profile having a shape that substantially conforms to a shape of a diaphragm used in a compression driver with the phasing plug.

6. The phasing plug of claim 5, where the shape includes either:

a V-shape to conform to a V-shaped diaphragm, a single half roll diaphragm to conform to a single half roll diaphragm, or a dual half roll diaphragm to conform to a dual half roll diaphragm; and the profile includes a closed region between the first and second circumferences that substantially overlays a region of maximum displacement on the annular diaphragm in the assembled compression driver, where the open area of the apertures does not extend substantially into the closed region.

7. The phasing plug of claim 5, where the profile has a circular apex between the first and second circumferences, and where an open area of the apertures does not extend substantially into the circular apex.

8. The phasing plug of claim 1 further comprising:

an exterior surface on the hub portion;

the exterior surface shaped to form a waveguide with an interior surface of a housing that surrounds the hub portion when the phasing plug is assembled in a compression driver.

9. The phasing plug of claim 8 where a voice coil actuates a diaphragm positioned at the annular section of the phasing plug to create sound waves through the apertures to propagate through the channels and into the waveguide formed by the interior surface of the housing that surrounds the hub portion when the phasing plug is assembled in a compression driver.

10. A compression driver comprising:

an annular diaphragm;

at least one suspension member for supporting the annular diaphragm while enabling the annular diaphragm to oscillate;

a voice coil attached to the annular diaphragm for actuating the annular diaphragm in the presence of a magnetic field;

a phasing plug comprising:

a base portion including a first side and a second side, and an annular section defined on the first side by a first circumference and a second smaller circumference, the first and second circumferences having a common center in the base portion, where the annular section substantially overlays the annular diaphragm;

a hub portion extending from the second side of the base portion substantially perpendicularly along an axis at the common center on the base portion;

a plurality of channels formed on the second side of the base portion, each channel extending from the hub portion to a corresponding one of a plurality of apertures extending between the first and second sides, the apertures formed to define lines cutting diagonally across the annular section;

the annular diaphragm being placed in substantial alignment with the annular section of the phasing plug; and a housing positioned on the second side of the base portion, the housing having an interior surface to enclose the hub portion so as to form a waveguide with the exterior surface of the hub portion.

11. The compression driver of claim 10, where the plurality of apertures on the phasing plug includes a plurality of sets of apertures, each set of apertures forming a line of apertures.

12. The compression driver of claim 11, where the plurality of apertures includes four sets of apertures each set forming a line of apertures arranged to cut across the annular section to form a square pattern.

13. The compression driver of claim 11, where the plurality of apertures include a plurality of sets of apertures each set forming a line of apertures tangential to a circle concentric with the annular section and having a smaller diameter than the annular section.

14. The compression driver of claim 10 where the annular section includes a profile having a shape that substantially conforms to a shape of a diaphragm used in a compression driver with the phasing plug.

15. The compression driver of claim 14, where the shape of the profile includes either:

a V-shape to conform to a V-shaped diaphragm, a single half roll diaphragm to conform to a single half roll diaphragm, or a dual half roll diaphragm to conform to a dual half roll diaphragm; and the profile includes a closed region between the first and second circumferences that substantially overlays a region of maximum displacement on the annular diaphragm in the assembled compression driver, where the closed region does not contain any apertures.

16. The compression driver of claim 14, where the profile includes a circular apex between the first and second circumferences, and where the open area of the apertures does not extend substantially into the circular apex.

17. The phasing plug of claim 16 where the voice coil actuates the diaphragm to create sound waves through the apertures to propagate through the channels and into the waveguide formed by the interior surface of the housing that surrounds the hub portion when the phasing plug is assembled in a compression driver.

* * * * *